US010020106B2

(12) United States Patent
Miyauchi et al.

(10) Patent No.: US 10,020,106 B2
(45) Date of Patent: Jul. 10, 2018

(54) REACTOR

(71) Applicant: TOYOTA JIDOSHA KABUSHIKI KAISHA, Toyota-shi, Aichi-ken (JP)

(72) Inventors: Hiroyuki Miyauchi, Toyota (JP); Hirotaka Kamijo, Aichi-ken (JP); Shuichi Hirata, Nisshin (JP); Satoshi Ito, Obu (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 269 days.

(21) Appl. No.: 14/976,423

(22) Filed: Dec. 21, 2015

(65) Prior Publication Data

US 2016/0189846 A1 Jun. 30, 2016

(30) Foreign Application Priority Data

Dec. 24, 2014 (JP) ..... 2014-260120

(51) Int. Cl.

| | |
|---|---|
| ***H01F 27/08*** | (2006.01) |
| ***H01F 27/10*** | (2006.01) |
| ***H01F 17/04*** | (2006.01) |
| ***H01F 27/06*** | (2006.01) |
| ***H01F 27/22*** | (2006.01) |

(52) U.S. Cl.

CPC ..... *H01F 17/04* (2013.01); *H01F 27/06* (2013.01); *H01F 27/22* (2013.01)

(58) Field of Classification Search

USPC ..... 336/61, 55–60

See application file for complete search history.

(56) References Cited

U.S. PATENT DOCUMENTS

| | | | | |
|---|---|---|---|---|
| 9,613,746 | B2 * | 4/2017 | Miyauchi | H01F 27/22 |
| 2009/0027151 | A1 * | 1/2009 | Nakatsu | H01F 3/14 336/212 |
| 2013/0222100 | A1 * | 8/2013 | Nomura | H01F 27/025 336/55 |
| 2014/0133204 | A1 * | 5/2014 | Yoshikawa | H01F 37/00 363/131 |
| 2014/0232508 | A1 * | 8/2014 | Inaba | H01F 37/00 336/233 |
| 2016/0125996 | A1 * | 5/2016 | Ko | H01F 27/025 336/60 |

FOREIGN PATENT DOCUMENTS

| | | | |
|---|---|---|---|
| JP | 2011-124242 | A | 6/2011 |
| JP | 2013-118208 | A | 6/2013 |
| JP | 5278559 | * | 9/2013 |

* cited by examiner

*Primary Examiner* — Elvin G Enad
*Assistant Examiner* — Kazi Hossain
(74) *Attorney, Agent, or Firm* — Sughrue Mion, PLLC

(57) ABSTRACT

A reactor includes a reactor body and a heat sink. The reactor body includes coil wire wound around a core. The heat sink is fixed to the reactor body through a heat transfer sheet. The heat sink includes a restricting wall for the heat transfer sheet such that expansion of the heat transfer sheet in a first direction is restricted more than expansion of the heat transfer sheet in a second direction. The first direction is an extending direction of the coil wire on a surface of the reactor body, which abuts on the heat transfer sheet. The second direction is an axis direction of the coil wire.

2 Claims, 6 Drawing Sheets

REACTOR

INCORPORATION BY REFERENCE

The disclosure of Japanese Patent Application No. 2014-260120 filed on Dec. 24, 2014 including the specification, drawings and abstract is incorporated herein by reference in its entirety.

BACKGROUND OF THE INVENTION

1. Field of the Invention

The present specification relates to a reactor in which a reactor body is fixed to a heat sink through a heat transfer sheet.

2. Description of Related Art

Japanese Patent Application Publication No. 2013-118208 (JP 2013-118208 A) discloses a technology for structuring a reactor body by covering a core with a bobbin and winding a coil around the bobbin. When the reactor body operates, heat is generated. In JP 2013-118208 A, a device is disclosed, in which the reactor body is fixed to a heat sink. In JP 2013-118208 A, in order to reduce heat resistance from the reactor body to the heat sink, a heat transfer sheet is interposed between the reactor body and the heat sink. In this specification, a device in which a reactor body is fixed to a heat sink through a heat transfer sheet is referred to as a reactor.

The heat transfer sheet needs to closely adhere to both the reactor body and the heat sink, and also needs to be flexible. Because a phenomenon of generating heat during an operation and cooling down when the operation ends is repeated in the reactor body, the heat transfer sheet is also exposed to a heating and cooling cycle. Since the heat transfer sheet is flexible, its thermal expansion coefficient is large. Because the heat transfer sheet having a large thermal expansion coefficient is exposed to a heat cycle, the heat transfer sheet repeats an expansion and contraction cycle. With the heat cycle, the reactor body and the heat sink that sandwich the heat transfer sheet also repeat an expansion and contraction cycle. Therefore, a range of expansion and contraction of the heat transfer sheet is increased. It is necessary to keep heat transfer sheet closely adhering to both the reactor body and the heat sink against the expansion and contraction cycle.

In JP 2013-118208 A, an expansion of the heat transfer sheet is prevented by allowing an end edge of the heat transfer sheet to abut on a side surface of a recess provided in the heat sink. The side surface is referred to as an expansion restricting wall. In JP 2013-118208 A, a structure is employed in which the rectangular heat transfer sheet is housed in a rectangular recess, and the entire length of an end edge of the heat transfer sheet in four peripheral sides abuts on the expansion restricting wall.

SUMMARY OF THE INVENTION

When the entire length of the end edge of the heat transfer sheet in all four peripheral sides abuts on the restricting wall, a life span of the heat transfer sheet extends. However, it becomes more difficult to carry out an operation for fixing the reactor body to the heat sink through the heat transfer sheet. When the heat transfer sheet is restricted in all of the four sides, a phenomenon such as wrinkles and local extension of the heat transfer sheet happens, and it becomes difficult to cause the reactor body to closely adhere to the flexible heat transfer sheet with uniform contact pressure.

Incidentally, a difference in an amount of deformation (referred to as a deformation range) of the heat transfer sheet when the heat transfer sheet is expanded and contracted is changed depending on a direction of the heat transfer sheet. On a surface of the reactor body that abuts on the heat transfer sheet, there are an extending direction of a coil wire (referred to as the first direction), and an axis direction of the core (the second direction) on which the coil wire is wound. As a result of an observation, it was found that, in the case where expansion of the heat transfer sheet is not restricted, a deformation range of the heat transfer sheet in the first direction is large, whereas the deformation range of the heat transfer sheet in the second direction is small. In order to extend a life span of the heat transfer sheet, it is effective to restrict expansion in the direction in which the deformation range is large. Meanwhile, it is possible to ensure a necessary life span without restricting expansion in the direction in which the deformation range is small. By permitting expansion in the direction in which the deformation range is small, it becomes easier to perform an operation of fixing the reactor body to the heat sink through the heat transfer sheet.

A reactor according to an aspect of the invention includes a reactor body and a heat sink. The reactor body includes coil wire wound around a core. The heat sink is fixed to the reactor body through a heat transfer sheet. The heat sink includes a restricting wall for the heat transfer sheet such that expansion of the heat transfer sheet in a first direction is restricted more than expansion of the heat transfer sheet in a second direction. The first direction is an extending direction of the coil wire on a surface of the reactor body, which abuts on the heat transfer sheet. The second direction is an axis direction of the coil wire.

In a case where expansion of the heat transfer sheet is not restricted, a deformation range in the first direction is large, and a deformation range in the second direction is small. In the reactor according to the above aspect, a life span of the heat transfer sheet is extended by providing the restricting wall that restricts expansion of the heat transfer sheet in the first direction in which the deformation range is large, rather than expansion of the heat transfer sheet in the second direction in which the deformation ranger is small. Further, since the expansion of the heat transfer sheet in the second direction is not restricted compared to expansion in the first direction, namely, the expansion is permitted, it becomes easier to carry out an operation of fixing the reactor body to the heat sink through the heat transfer sheet.

When expansion in the second direction is not restricted as much as the expansion in the first direction, cases are included where no restricting wall is provided in the second direction, and where restricting walls abutting on parts of both end edges in the second direction are provided, thus permitting expansion in areas other than the abutting parts. When expansion in the first direction is restricted, cases are included where restricting walls are provided, which abut on the entire lengths of both end edges in the first direction, respectively, and where a non-abutting part is provided in a part of the restricting wall. In the reactor according to the above aspect, the heat sink may include a first restricting wall, which restricts expansion of the heat transfer sheet in the first direction, and a second restricting wall, which restricts expansion of the heat transfer sheet in the second direction. A percentage of a length of an end edge of the heat transfer sheet, which abuts on the first restricting wall, out of the entire length of the end edge of the heat transfer sheet may be larger than a percentage of a length of an end edge of the transfer sheet, which abuts on the second restricting wall, out of the entire length of the end edge of the heat transfer sheet.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

First, characteristics of the examples explained below are explained. (Characteristic 1) A restricting wall is formed, which abuts on the entire length of an end edge in the first direction. (Characteristic 2) A restricting wall is formed, which abuts on a part of an end edge in a first direction. A length of the end edge of a heat transfer sheet, which abuts on the restricting wall, is larger than a length of an end edge of the heat transfer sheet that does not abut on the restricting wall. (Characteristic 3) A restricting wall, which abuts on the end edge in a second direction, is not formed. (Characteristic 4) A restricting wall is formed, which abuts on a part of an end edge in the second direction. A length of an end edge of the heat transfer sheet, which abuts on the restricting wall, is smaller than a length of an end edge of the heat transfer sheet, which does not abut on the restricting wall. (Characteristic 5) An outer surface of the reactor body, except a surface that abuts on the heat transfer sheet, is covered with a resin mold. A coil is exposed on the surface that abuts on the heat transfer sheet. (Characteristic 6) The heat transfer sheet has an insulation property. (Characteristic 7) The heat transfer sheet is made from a silicon resin and flexible.

A reactor according to the first example is used for a converter that converts voltage of a battery in an automobile run by a motor. Since large current flows in the reactor, a coil is formed by a rectangular wire having small internal resistance. Because a large amount of heat is generated in the reactor, a heat sink is provided.

Figure 1:
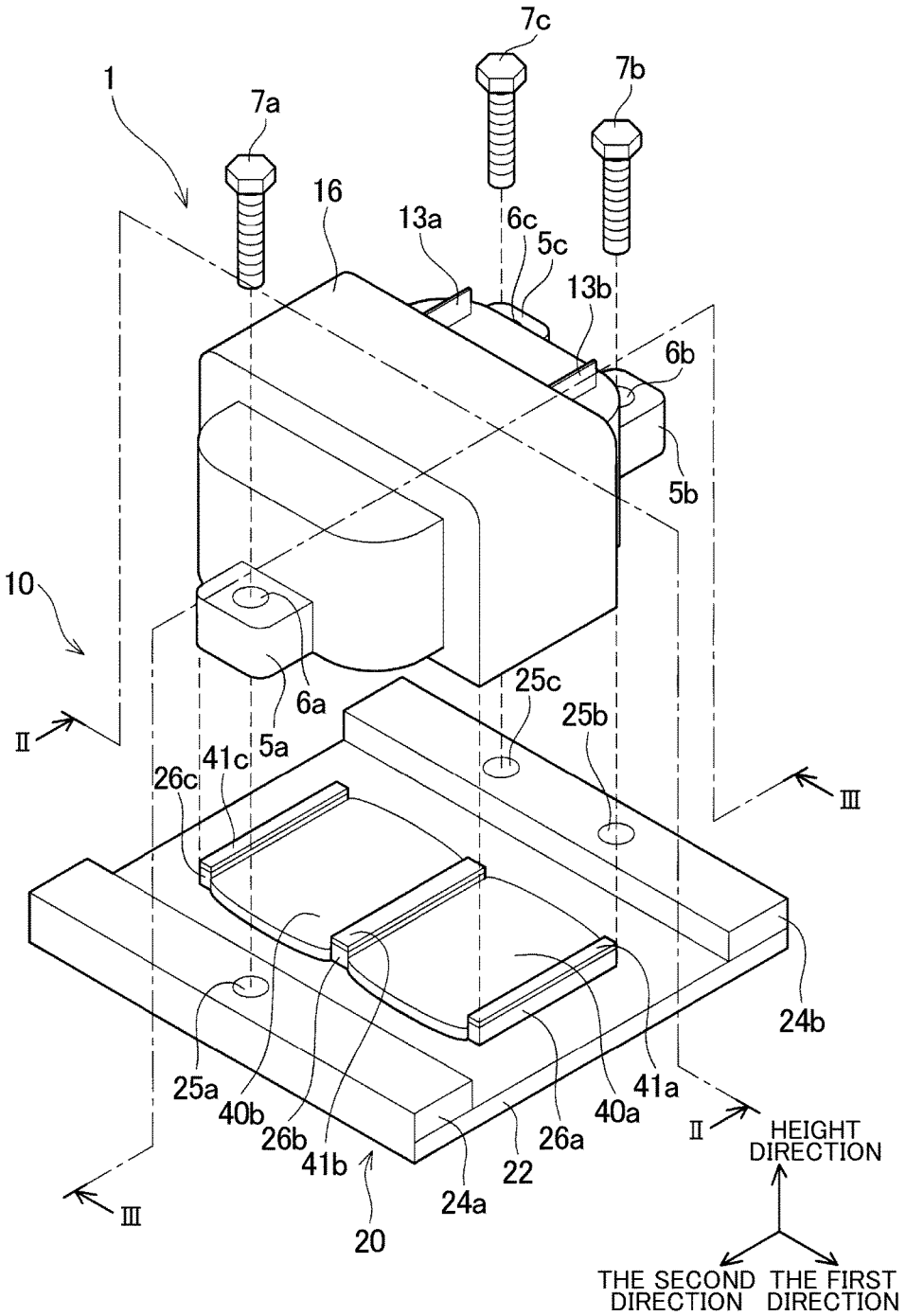
FIG. 1 is an exploded perspective view of a reactor according to the first example.
Figure 2:
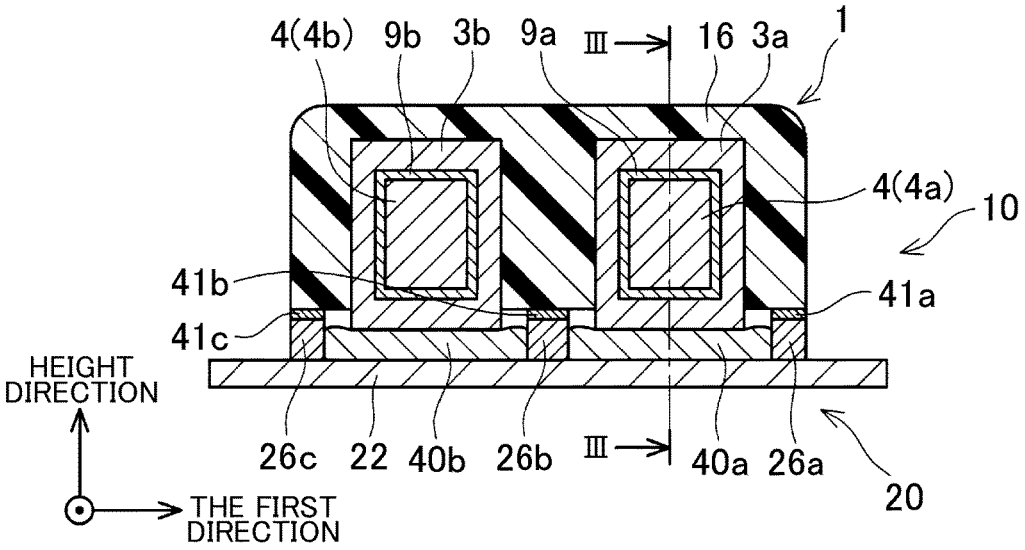
FIG. 2 is a sectional view of the reactor shown in FIG. 1 cut along the line II-II in FIG. 1.
Figure 3:
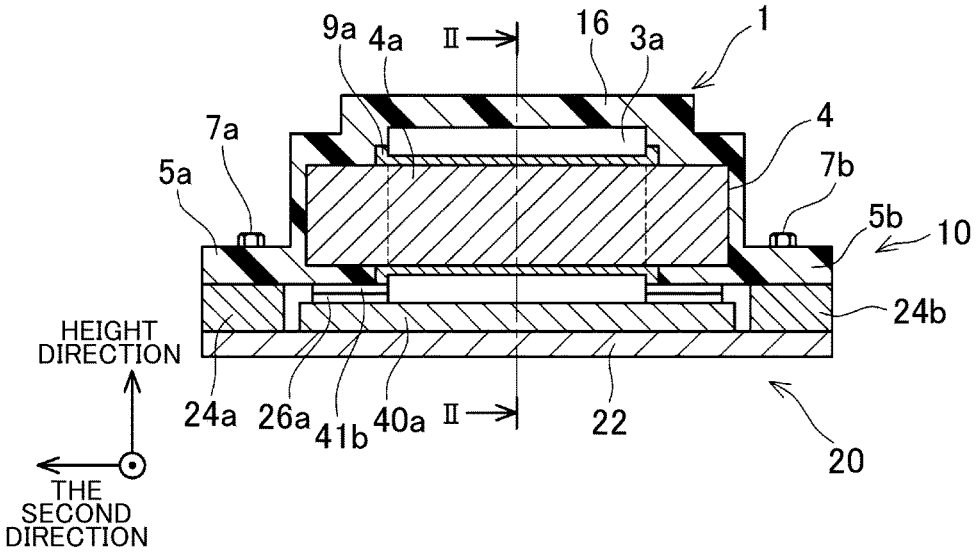
FIG. 3 is a sectional view of the reactor shown in FIG. 1 cut along the line III-III in FIG. 1.

FIG. 1 is an exploded perspective view of a reactor 10. The reactor 10 includes a reactor body 1. The reactor body 1 is provided with a core 4 having a shape of a track in an athletic stadium when seen in a height direction (see FIG. 2 and FIG. 3), a bobbin 9 that covers the periphery of the core 4, a coil 3 in which coil wire is wound around the bobbin 9, namely around the core 4, and a resin mold 16 that covers the core 4, the bobbin 9, and the coil 3. As shown in FIG. 2 and FIG. 3, a lower surface of the reactor body 1 is not covered by the resin mold 16 and the coil 3 is exposed. An exposed lower surface of the coil 3 faces upper surfaces of the heat sink 20 through heat transfer sheets 40*a*, 40*b*. A lower surface of the heat sink 20 is exposed to a heat radiation medium such as gas (for example, air) or a liquid (for example, a cooling liquid). FIG. 2 shows a pair of straight portions 4*a*, 4*b* of the core 4, a pair of cylindrical portions 9*a*, 9*b* of the bobbin 9, a coil 3*a* wound around the cylindrical portion 9*a*, and a coil 3*b* wound around the cylindrical portion 9*b*. The coil 3*a* and the coil 3*b* are connected with each other in series, and substantially form a single coil 3. Reference numerals 13*a*, 13*b* in FIG. 1 denote a pair of lead end parts of the coil 3. In the explanation below, a phenomenon common to the coils 3*a*, 3*b* is explained without the subscripts. This applies to the other reference numerals.

As shown in FIG. 2 and FIG. 3, the resin mold 16 is not formed near the lower surface of the reactor body 1. On the lower surface of the reactor body 1, the lower surfaces of the coils 3*a*, 3*b* are exposed. On the exposed surfaces that abut on the heat transfer sheets 40*a*, 40*b*, the coil wire extends in the first direction shown in FIG. 1 and FIG. 2. An axis of the core 4, around which the coil wire is wound, extends in the second direction shown in FIG. 1 and FIG. 3.

As shown in FIG. 1, in the resin mold 16, three attaching parts 5 (5*a*, 5*b*, 5*c*) are formed. The attaching parts 5*a*, 5*b*, 5*c* have holes 6*a*, 6*b*, 6*c*, respectively.

The heat sink 20 is a cooler for cooling the reactor body 1 and is made from a metal material having high thermal conductivity. The heat sink 20 is provided with a bottom plate 22 and side plates 24*a*, 24*b*. The side plates 24*a*, 24*b* are provided along both end edges of the bottom plate 22 in the second direction. One opening 25*a* is provided in an upper surface of one side plate 24*a*, and openings 25*b*, 25*c* are provided in an upper surface of the other side plate 24*b*. When the reactor body 1 is mounted on the heat sink 20, a positional relation is such that the opening 25*a* corresponds to the hole 6*a*, the opening 25*b* corresponds to the hole 6*b*, and the opening 25*c* corresponds to the hole 6*c*.

The two rectangular heat transfer sheets 40*a*, 40*b* are arranged on an upper surface of the bottom plate 22. The lengths of the heat transfer sheets 40*a*, 40*b* in the second direction are generally equal to the length of the coil 3 in the second direction. The lengths of the heat transfer sheets 40*a*, 40*b* in the first direction are generally equal to the length of the coil 3 in the first direction. When the reactor body 1 is mounted on the heat sink 20, the heat transfer sheet 40*a* is interposed between the coil 3*a* and the heat sink 20, and the heat transfer sheet 40*b* is interposed between the coil 3*b* and the heat sink 20.

Three restricting walls 26*a*, 26*b*, 26*c* are provided in the heat sink 20. The three restricting walls 26*a*, 26*b*, 26*c* are formed at positions along both end edges of the heat transfer sheets 40*a*, 40*b* in the first direction. The restricting wall 26*b* is positioned in a midpoint between the heat transfer sheets 40*a*, 40*b* and abuts on the end edges of the heat transfer sheets 40*a*, 40*b* near the center. The restricting wall 26*a* abuts on the end edge of the heat transfer sheet 40*a* on an outer side. The restricting wall 26*c* abuts on the end edge of the heat transfer sheet 40*b* on an outer side. The lengths of the restricting walls 26*a*, 26*b*, 26*c* are generally equal to the length of the heat transfer sheet 40*a*, 40*b* in the second direction. The restricting walls 26*a*, 26*b* abut on the entire lengths of both end edges of the heat transfer sheet 40*a* in the first direction, thereby restricting the heat transfer sheet 40*a* from expanding in the first direction. The restricting walls 26*b*, 26*c* abut on the entire lengths of both end edges of the heat transfer sheet 40*b* in the first direction, thereby restricting the heat transfer sheet 40*b* from expanding in the first direction.

As shown in FIG. 1 and FIG. 3, heat transfer sheets 41*a*, 41*b*, 41*c* are sandwiched between the reactor body 1, and upper surfaces of the restricting walls 26*a*, 26*b*, 26*c*, respectively. The resin mold 16 is pressed against the three heat transfer sheets 41. Heat generated in the reactor body 1 is radiated to the heat sink 20 through the heat transfer sheets 40*a*, 40*b*.

As screws 7*a*, 7*b*, 7*c* are screwed into the openings 25*a*, 25*b*, 25*c* from the holes 6*a*, 6*b*, 6*c*, respectively, the reactor body 1 is attached to the heat sink 20 through the heat transfer sheets 40*a*, 40*b*. The coil 3*a* projecting from the resin mold 16 closely adheres to the heat transfer sheet 40*a* while crushing the heat transfer sheet 40*a*, and the coil 3*b* closely adheres to the heat transfer sheet 40*b* while crushing the heat transfer sheet 40*b*.

Being pressed by the coil 3, the heat transfer sheets 40*a*, 40*b* try to expand in the first direction and the second direction. In the first direction, the end edges of the heat transfer sheets 40*a*, 40*b* come into contact with the restricting walls 26*a*, 26*b*, 26*c*. Thus, the heat transfer sheets 40*a*, 40*b* are not able to expand in the first direction. If no restricting walls 26*a*, 26*b*, 26*c* are provided in the heat sink 20, when a heat cycle is applied to the reactor body 1, the heat transfer sheets 40*a*, 40*b* expand greatly and contract greatly in the first direction. Due to this deformation, the heat transfer sheets 40*a*, 40*b* are deteriorated, thus shortening the life span of the heat transfer sheets 40*a*, 40*b*. In this example, the deformation is restricted because both end edges of the heat transfer sheets 40*a*, 40*b* abut on the restricting walls 26*a*, 26*b*, 26*c* in the first direction. Because of this, the life span of the heat transfer sheets 40*a*, 40*b* extends. On the other hand, the heat transfer sheets 40*a*, 40*b* are able to expand in the second direction. When the heat transfer sheets 40*a*, 40*b* are able to expand in the second direction, it becomes easy to carry out an operation of fixing the reactor body 1 to the heat sink 20 through the heat transfer sheets 40*a*, 40*b*. Since the heat transfer sheets 40*a*, 40*b* are able to expand in the second direction, when a heat cycle is applied to the reactor body 1, the heat transfer sheets 40*a*, 40*b* expand and contract in the second direction. However, an amount of the deformation is small, and the life span of the heat transfer sheets 40*a*, 40*b* are not shortened so responsively by the deformation.

Figure 4:
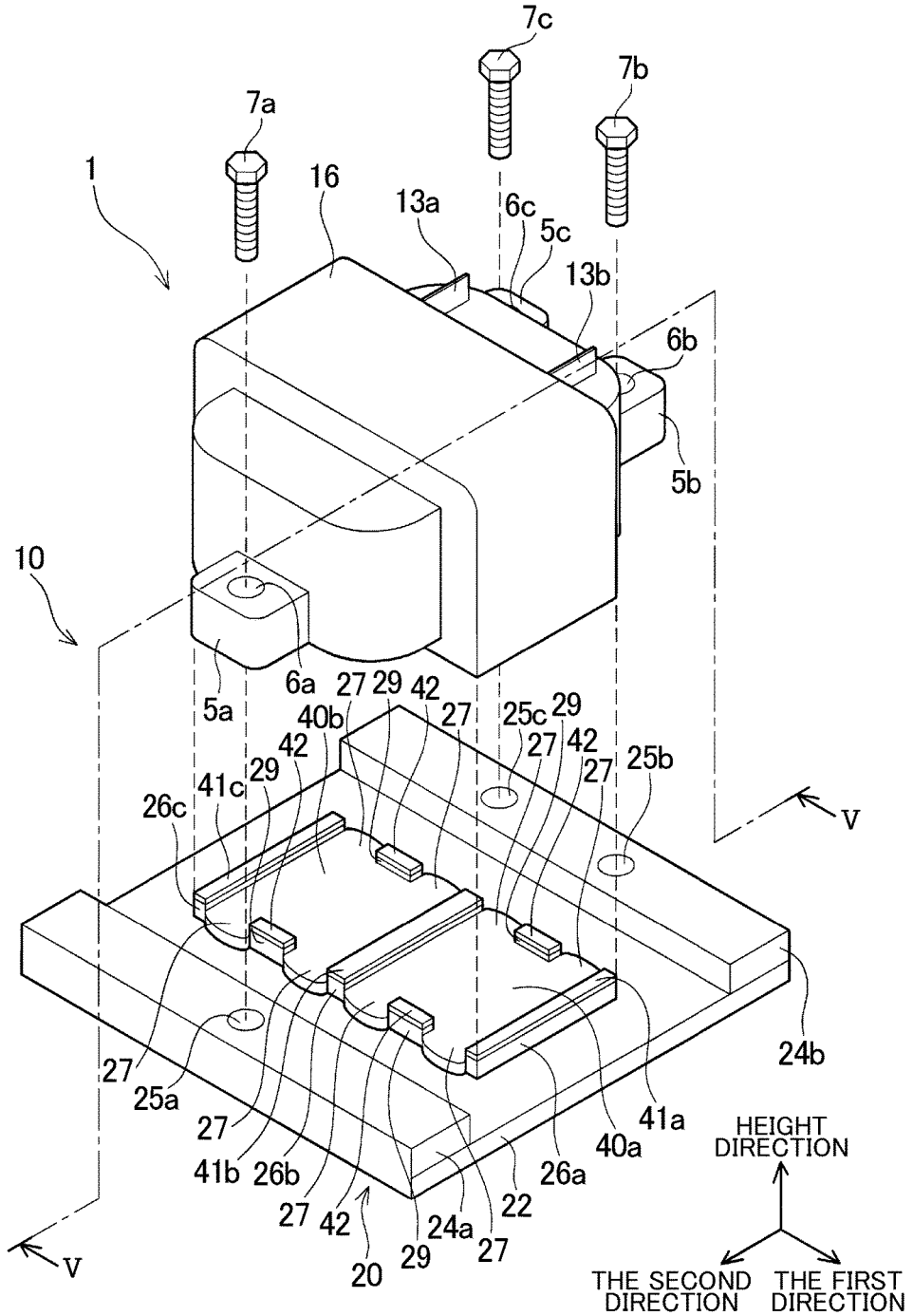
FIG. 4 is an exploded perspective view of a reactor according to the second example.
Figure 5:
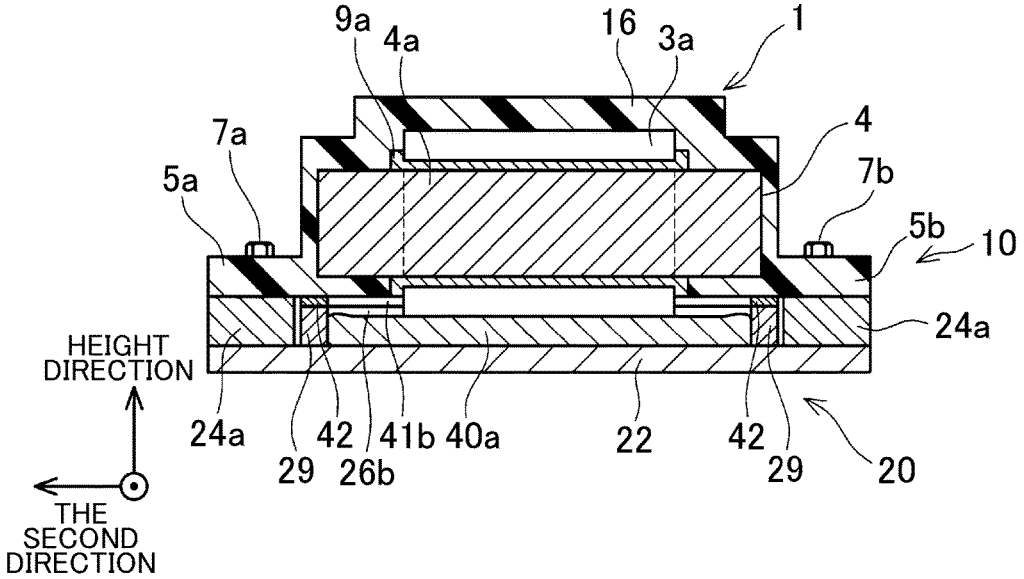
FIG. 5 is a sectional view of the reactor shown in FIG. 4 cut along the line V-V in FIG. 4.

The second example is explained mainly regarding a difference from the first example. FIG. 4 is an exploded perspective view of a reactor 10 according to the second example. In a heat sink 20 in the second example, four restricting walls 29 are provided in addition to restricting walls 26*a*, 26*b*, 26*c*. The four restricting wall 29 are formed in the heat sink 20. The four restricting walls 29 are provided at positions along both end edges of heat transfer sheets 40*a*, 40*b* in the second direction. Each of the restricting walls 29 has two cutouts 27 on both ends. In other words, the length of each of the restricting walls 29 is smaller than the length of the heat transfer sheet 40*a*, 40*b* in the first direction. Once the reactor body 1 is attached to the heat sink 20, the heat transfer sheets 40*a*, 40*b* are restricted from expanding in the second direction at the positions where the restricting walls 29 are present. Meanwhile, at the positions occupied by the cutouts 27, the heat transfer sheets 40*a*, 40*b* are able to expand into the cutouts 27. Therefore, expansion of the heat transfer sheets 40*a*, 40*b* in the second direction is permitted.

In the second example, unlike the first example, expansion of the heat transfer sheets 40*a*, 40*b* in the second direction is restricted to some extent. Therefore, an amount of pressure required when attaching the reactor body 1 to the heat sink 20 through the heat transfer sheets 40*a*, 40*b* becomes larger than that in the first example. However, it is possible to improve durability of the heat transfer sheets 40*a*, 40*b* more in comparison to the first example. In this example, with regard to the restricting walls 26*a*, 26*b*, 26*c* that restrict expansion in the first direction, a percentage of "the length of the end edge of the heat transfer sheets 40*a*, 40*b*, which abuts on the restricting wall 26*a*, 26*b*, 26*c*, out of the entire length of the end edge of the heat transfer sheets 40*a*, 40*b*" is 100%. With regard to the restriction wall 29 that restricts expansion in the second direction, a percentage of "the length of the end edge of the heat transfer sheets 40*a*, 40*b*, which abuts on the restricting wall 29, out of the entire length of the end edge of the heat transfer sheets 40*a*, 40*b*" is a percentage of "the length of the restricting wall 29 out of (the length of the restricting wall 29+twice of the length of the cutout 27)", and the former is larger than the latter.

Figure 6:
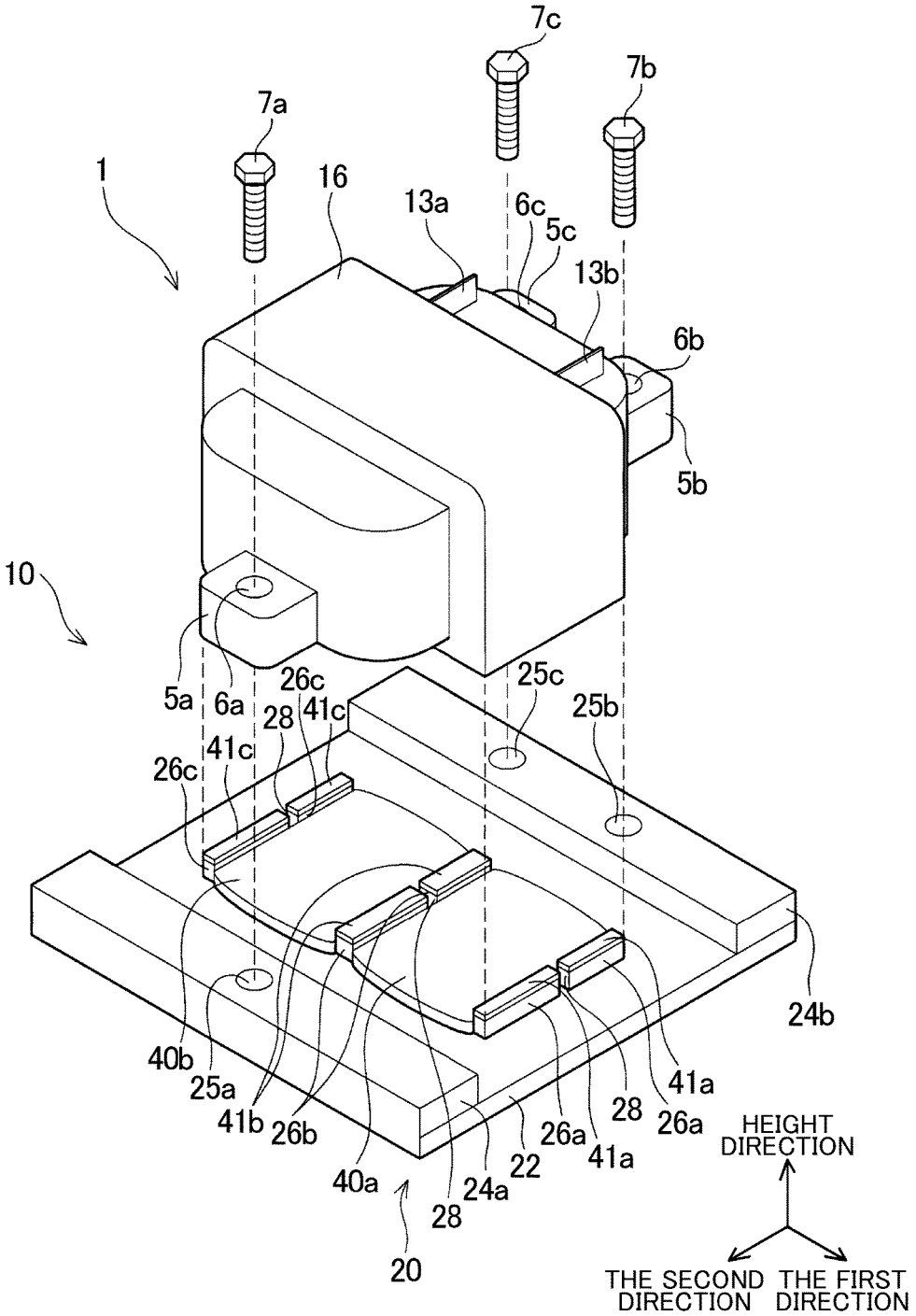
FIG. 6 is an exploded perspective view of a reactor according to the third example.

The third example is explained mainly regarding a difference from the first example. FIG. 6 is an exploded perspective view of a reactor 10 according to the third example. Each restricting wall 26*a*, 26*b*, 26*c* according to the third example has a cutout 28 in the center. Herein below, physically two restricting walls 26*a*, 26*b*, 26*c* sandwiching the cutout 28 are considered as a single restricting wall 26*a*, 26*b*, 26*c*. The length of the restricting wall 26*a*, 26*b*, 26*c* (namely, the sum of lengths of the above-mentioned physically two restricting walls 26*a*, 26*b*, 26*c*) is shorter than the length of a heat transfer sheets 40*a*, 40*b* in the second direction. Once the reactor body 1 is attached to a heat sink 20, expansion of the heat transfer sheets 40*a*, 40*b* in the first direction is restricted at positions where the restricting walls 26*a*, 26*b*, 26*c* are present. Meanwhile, at positions occupied by the cutouts 28, the heat transfer sheets 40*a*, 40*b* are able to expand into the cutouts 28, and expansion of the heat transfer sheets 40*a*, 40*b* in the first direction is permitted.

In the third example, unlike the first example, expansion of the heat transfer sheets 40*a*, 40*b* in the first direction are permitted to some extent. Therefore, durability of the heat transfer sheets 40*a*, 40*b* are smaller than that in the first example. However, an amount of pressure required when attaching the reactor body 1 to the heat sink 20 through the heat transfer sheets 40*a*, 40*b* are smaller than that in the first example. In this example, regarding the restricting wall 26*a*, 26*b*, 26*c* that restricts expansion in the first direction, a percentage of "the length of the end edge of the heat transfer sheets 40*a*, 40*b*, which abuts on the restricting wall 26*a*, 26*b*, 26*c*, out of the entire length of the end edge of the heat transfer sheets 40*a*, 40*b*" is a percentage of "the length of the restricting wall 26*a*, 26*b*, 26*c* out of (the length of the restricting wall 26*a*, 26*b*, 26*c*+the length of the cutout 28)", and, expansion in the second direction is not restricted.

In the first example, a cutout may be provided in the restricting wall 26*a*, 26*b*, 26*c* in order to release air accumulated between the heat transfer sheets 40*a*, 40*b* and the restricting wall 26*a*, 26*b*, 26*c*. Since the cutout is short enough, an expanded part of the heat transfer sheets 40*a*, 40*b* does not enter the cutout even when the reactor body 1 is attached to the heat sink 20. In this case, regarding the restricting wall 26*a*, 26*b*, 26*c* that restricts expansion in the first direction, a percentage of "the length of the end edge of the heat transfer sheets 40*a*, 40*b*, which abuts on the restricting wall 26*a*, 26*b*, 26*c*, out of the entire length of the end edge of the heat transfer sheets 40*a*, 40*b*" is practically 100%.

The restricting wall 26*a*, 26*b*, 26*c* in the second example has the cutouts 27 but may have, for example, holes instead. In short, means for permitting expansion of the heat transfer sheets 40*a*, 40*b* in the second direction is not limited to cutouts.

Specific examples of the invention have been explained in detail, but are examples only, and do not limit the scope of the claims. The techniques described in the scope of claims include various modifications and changes of the specific examples described above. The technical elements explained in this specification and the drawings achieve technical utility alone or as various combinations, and are not limited to the combinations described in the claims on filing. Moreover, the techniques described as examples in the specification and the drawings are able to achieve a plurality of objectives simultaneously and have technical utility by achieving one of the objectives.

What is claimed is:

1. A reactor comprising:

a reactor body including a coil wire wound around a core;

a heat transfer sheet; and a heat sink fixed to the reactor body through the heat transfer sheet, wherein the heat sink includes a first restricting wall that abuts the heat transfer sheet and is configured to restrict expansion of the heat transfer sheet in a first direction, and expansion of the heat transfer sheet in the first direction is restricted more than expansion of the heat transfer sheet in a second direction, the first direction being an extending direction of the coil wire on a surface of the reactor body, and the second direction being an axis direction of the core around which the coil wire is wound.

2. The reactor according to claim 1, wherein the heat sink further includes a second restricting wall that abuts the heat transfer sheet and is configured to restrict expansion of the heat transfer sheet in the second direction, and a percentage of a length of an end edge of the heat transfer sheet, which abuts on the first restricting wall, out of an entire length of the end edge of the heat transfer sheet is larger than a percentage of a length of an end edge of the heat transfer sheet, which abuts on the second restricting wall, out of the entire length of the end edge of the heat transfer sheet.

* * * * *